US006358467B1

(12) United States Patent
Mordue

(10) Patent No.: US 6,358,467 B1
(45) Date of Patent: Mar. 19, 2002

(54) UNIVERSAL COUPLING

(75) Inventor: George S. Mordue, Ravenna, OH (US)

(73) Assignee: Metaullics Systems Co., L.P., Solon, OH (US)

( * ) Notice: Subject to any disclaimer, the term of this patent is extended or adjusted under 35 U.S.C. 154(b) by 0 days.

(21) Appl. No.: 09/544,917

(22) Filed: Apr. 7, 2000

Related U.S. Application Data

(60) Provisional application No. 60/128,527, filed on Apr. 9, 1999.

(51) Int. Cl.[7] ..... C21C 7/00
(52) U.S. Cl. ..... 266/235; 222/602
(58) Field of Search ..... 266/235, 239; 222/602

(56) References Cited

U.S. PATENT DOCUMENTS

| | | | | |
|---|---|---|---|---|
| 3,048,384 A | | 8/1962 | Sweeney et al. | |
| 3,836,280 A | | 9/1974 | Koch | |
| 4,898,367 A | | 2/1990 | Cooper | |
| 5,025,198 A | | 6/1991 | Mordue et al. | |
| 5,028,211 A | | 7/1991 | Mordue et al. | |
| 5,092,821 A | | 3/1992 | Gilbert et al. | |
| 5,203,681 A | | 4/1993 | Cooper | |
| 5,685,701 A | * | 11/1997 | Chandler et al. | 266/235 |
| 6,045,015 A | * | 4/2000 | Waltensphul et al. | 222/597 |

FOREIGN PATENT DOCUMENTS

| | | | |
|---|---|---|---|
| BE | 878282 | | 11/1979 |
| DE | 30 30040 | A1 | 3/1982 |
| DE | 3501860 | A1 | 9/1985 |
| FR | 2 763 079 | A1 | 11/1998 |

* cited by examiner

*Primary Examiner*—Scott Kastler
(74) *Attorney, Agent, or Firm*—Fay, Sharpe, Fagan, Minnich & McKee, LLP

(57) ABSTRACT

A coupling mechanism for a molten metal processing system includes an elongated shaft having an upper axial end and a lower axial end. A passage having a torque facilitating shape extends through at least a portion of the shaft. The upper end of the shaft tapers inwardly and forms a tapered seat. At least one channel is machined into an outer surface of the upper end of the shaft. The channel has a first portion extending longitudinally downward from a top surface of the shaft and a second portion extending from the first portion at an angle greater than 90° relative to the first portion. A coupling member, for coupling the shaft to a drive system, includes a body having an annular wall which defines a cavity. At least one locking member is disposed on an inner surface of the annular wall which is adapted to cooperate with the channel in the shaft. The locking member is aligned with the first portion of the channel and the shaft is slid into the cavity. When the locking member reaches a bottom surface of the first portion of the channel, the shaft is turned less than one third of a rotation so that the locking member travels partially across the second portion of the channel thereby pulling the shaft upward. The cavity of the coupling member tapers outwardly forming a mouth which engages the tapered seat of the shaft in a sealing relationship.

33 Claims, 4 Drawing Sheets

UNIVERSAL COUPLING

This application is based upon Provisional Application No. 60/128,527, filed on Apr. 9, 1999.

BACKGROUND OF THE INVENTION

1. Field of the Invention

This invention relates generally to the art of processing and treating molten metal. More particularly, this invention relates to a new and improved coupling design for a molten metal processing system.

2. Discussion of the Art

Molten metal processing systems can usually be classified into several different types of systems. For example, degassing/flux injection, submergence and pumps are frequently used general categories.

Systems which fall into the degassing/flux injection category generally operate to remove impurities from molten metal. More specifically, these systems remove dissolved metals, such as magnesium, release dissolved gases, such as hydrogen, from molten metal, and through floatation remove suspended solid impurites. In order to achieve these functions, gases or fluxes are introduced into a molten metal bath which chemically react with the impurities to convert them to a form (such as a precipitate or a dross) that can be separated readily from the remainder of the molten metal.

Systems which fall into the submergence category generally operate to melt scrap metal, such as by-products of metal processing operations and aluminum beverage cans, in order to recover the scrap metal for productive use. In a typical submergence system, the scrap metal is introduced onto the surface of the molten metal and drawn downward or submerged within the molten metal where it is melted. In its melted form, the scrap metal is substantially ready for productive use.

The pump category can be further classified into three different types of systems including transfer pumps, discharge pumps, and gas-injection pumps. A transfer pump typically transfers molten metal from one furnace to another furnace. A discharge pump transfers molten metal from one bath chamber to another bath chamber. A gas-injection pump circulates molten metal and adds a gas into the flow of molten metal. Although the present invention is particularly well suited for use with a gas-injection pump or degassing system, it must be appreciated that this invention may be used with any rotor/shaft system, including but not limited to the systems mentioned above.

Known molten metal processing apparatus of the foregoing types typically include the common feature of a motor carried by a motor mount, a shaft connected to the motor at an upper end, and an impeller or rotor connected at a lower end of the shaft. A coupling mechanism is used to connect the upper end of the shaft to the motor. The components are usually manufactured from a refractory material, such as graphite or ceramic. In operation, the motor drives the shaft which rotates the impeller about its central vertical axis. The rotating impeller may serve any number of functions. For example, in a submergence system the impeller may draw molten metal downwardly to assist in the submergence of scrap materials deposited on the surface of the melt. In a pump system, the impeller may be contained within a housing to effect a pumping action on the metal. In a degassing/flux injection system, the impeller may introduce gas or flux into the molten metal via a passage located in the impeller body. Furthermore, the impeller may serve other conventional functions.

An important feature of impeller/shaft systems is the coupling mechanism which connects the upper end of the shaft to the motor. With reference to FIGS. 1A–1C, a series of shafts for known coupling designs are shown. Connecting an upper end of a shaft to a motor is most commonly achieved via a straight thread design as shown in FIG. 1A. The straight thread design includes an upper end 10' having a plurality of external threads 12'. The threaded upper end is threaded into a coupling (not shown) extending down from a drive system (not shown). Like any conventional threading mechanism, the shaft is screwed into the coupling by turning it several times until it is tight and secure.

The straight thread design suffers from several shortcomings. During operation, the shaft of a rotor/shaft system is exposed to a number of forces, particularly shear forces resulting from cantilever loading. The straight thread design is a relatively weak coupling because the machining of the coupling causes stress risers in a ceramic or graphite shaft. This results in an increased potential for shaft failure which is obviously undesirable. Furthermore, when a shaft breaks, it typically breaks just below the coupling leaving little if any shaft extending from the coupling. Thus, there is little material to work with in order to unscrew the stub. In addition, because the resistance of the straight thread design is equal in both directions, it is extremely difficult to unscrew. In other words, a significant amount of torque is required to remove the stub. A chisel and hammer are generally required to accomplish removal.

Removing the stub with a chisel and hammer causes additional problems. The use of a chisel to remove the graphite stub may accidentally deform the threads in the coupling. Thus, the threads will have to be re-formed to their original dimensions. Such re-forming operations are time consuming and often result in shaft run-out. Moreover, because graphite is a soft material, the normal replacement of the shaft in a straight thread design may lead to graphite deposit in the coupling threads, resulting in binding and shaft run-out.

Additional problems arise when the straight thread design is used in connection with a degassing system. When used for such applications, the straight thread does not operate with optimal sealing properties which is an important characteristic for degassing systems to prevent leakage of the purge gas.

Two other known coupling designs have been introduced in order to overcome some of the problems associated with the straight thread design. The first is an electrode thread design, as shown in FIG. 1B. The electrode thread design includes a recess 14' in the upper axial end of the shaft having a series of internal axial threads 16'. A male mating member (not shown) threads into the recess thereby connecting the drive system to the shaft. The second coupling is a tapered design which is shown in FIG. 1C. In this design, the upper end of the shaft is tapered and is configured to frictionally fit into a coupling (not shown). A male threaded shaft (not shown) extends from the coupling and fastens into a tapped bore 20' extending through the central axis of the shaft.

The tapered design provides marginally increased strength to resist the lateral forces applied to the shaft. When the shaft does break for the tapered design, it is tedious to remove the portion of the shaft which still remains connected to the motor. The resistive force or required torque to remove the remainder of the shaft is so great that removal of a broken shaft can be done only with a significant amount of time and effort and a risk of damaging the coupling.

The electrode thread design also provides marginally increased strength to resist the lateral forces applied to the shaft. However, when the electrode thread design is used in connection with degassing equipment, it suffers from poor sealing properties which is an undesirable characteristic in such an application. Such a system does not seal well because of the large threads which are used. Additionally, because the threads are of a relatively soft material, they experience deformation which makes removal or backing off of the shaft extremely difficult.

Accordingly, a need exists in the art of processing molten metal to provide a coupling design for rotor/shaft systems which has optimal sealing properties, low run-out potential, relatively high strength to resist transverse forces, and can be easily removed at the end of its life or upon shaft failure. The present invention achieves such advantages and others.

SUMMARY OF THE INVENTION

In accordance with one aspect of the present invention, a coupling mechanism for a molten metal processing system includes an elongated shaft having a first axial end and a second axial end. The shaft preferably includes a passage extending longitudinally from a top surface of the shaft. The passage has a torque facilitating shape suited for accommodating a wrenching tool. At least one channel is disposed on an outer surface of the first axial end of the shaft. A coupling member connects the first axial end of the elongated shaft to a drive system. The coupling member has a cavity for receiving the first end of the shaft. The coupling member further includes at least one locking member disposed on a wall of the cavity that is adapted to cooperate with the at least one channel in a locking relationship. Typically the coupling is metal such as steel and the shaft is graphite or ceramic.

In accordance with another aspect of the present invention, a coupling device for a molten metal processing system includes at least one channel in a first surface and at least one locking member mounted to a second surface. The locking member is adapted to cooperate with the channel in a locking relationship.

In accordance with another aspect of the present invention, a molten metal processing system includes a drive system. A coupling member extends downward from the drive system. The coupling member couples a first end of an elongated shaft to the drive system. A passage having a torque facilitating shape extends longitudinally through the elongated shaft.

In accordance with another aspect of the present invention, a method for coupling a shaft of a molten metal processing system to a motor of the molten metal processing system includes forming a series of channels into an upper end of the shaft. The channels include having a first portion extending vertically downward from a top surface of the shaft and a second portion extending from the first portion at an angle greater than 90° relative to the first portion. A series of locking members are provided on an inner surface of an annular wall of a coupling member which cooperate with the channels. The locking members are aligned with the channels. The shaft is then slid into the coupling member until the locking members have reached a bottom surface of the first portions of the channels. The shaft is turned so that the locking members travel partially through the second portions of the channels until the coupling member and the shaft are securely connected.

One advantage of the present invention is the provision of a coupling design that enables easy removal of a shaft stub which remains in a coupling member upon shaft failure.

Another advantage of the present invention is the provision of a coupling design that enables an operator to couple a shaft to a drive system in a quick and easy manner.

Another advantage of the present invention is the provision of a coupling design that provides optimal sealing properties for a degassing system.

Another advantage of the present invention is the provision of a coupling member that is formed into one piece which enables a shaft to be coupled to a drive system in a quick, easy, and efficient manner without having to deal with several tedious components.

Yet another advantage of the present invention is the provision of a coupling design which when machined reduces the occurrence of stress risers thereby increasing the ultimate strength of a rotor/shaft system.

Still another advantage of the present invention is the provision of a coupling device which reduces the potential for shaft run-out.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, several embodiments of which will be described in detail in this specification and illustrated in the accompanying drawings which form a part hereof and wherein.

DETAILED DESCRIPTION OF A PREFERRED EMBODIMENT

Reference will now be made in detail to the present preferred embodiment of the invention, an example of which is illustrated in the accompanying drawings. While the invention will be described in connection with the preferred embodiment, it will be understood that it is not intended to limit the invention to that embodiment. On the contrary, it is intended to cover all alternatives, modifications and equivalents that may be included within the spirit and scope of the invention defined by the appended claims.

The present invention is directed toward a coupling design for molten metal processing systems and is particularly well suited for degassing/flux injection applications. In operation, these systems inject argon, nitrogen, chlorine, fluxes and/or other appropriate gases or materials into a molten metal bath via an assembly consisting of a rotor connected to the lower end of a hollow shaft. The injected media removes dissolved gas such as hydrogen, may react with alkaline elements, and via floatation removes suspended particulate. Although well suited for degassing/flux injection applications, it must be appreciated that the present invention may be advantageously used with any rotor/shaft system.

Figure 1A:
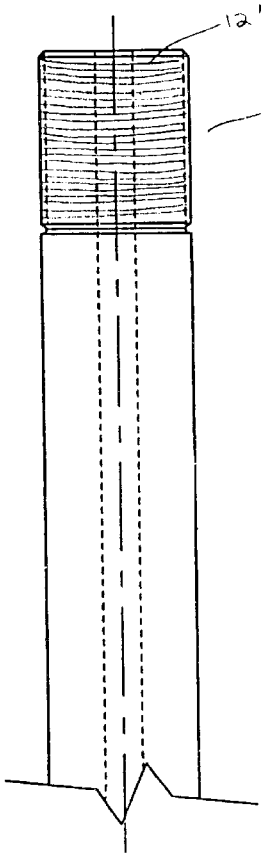
FIG 1A (Prior Art)
FIG. 1A is a side view of an upper end of a shaft for a straight thread coupling design in accordance with a known prior art design.
Figure 1B:
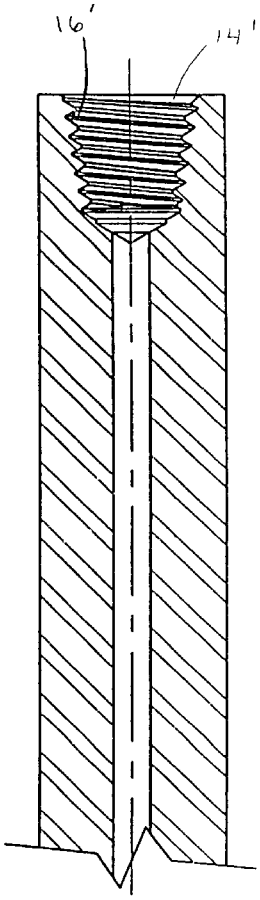
FIG 1B (Prior Art)
FIG. 1B is a cross-sectional view of an upper end of a shaft for an electrode thread coupling design in accordance with a known prior art design.
Figure 1C:
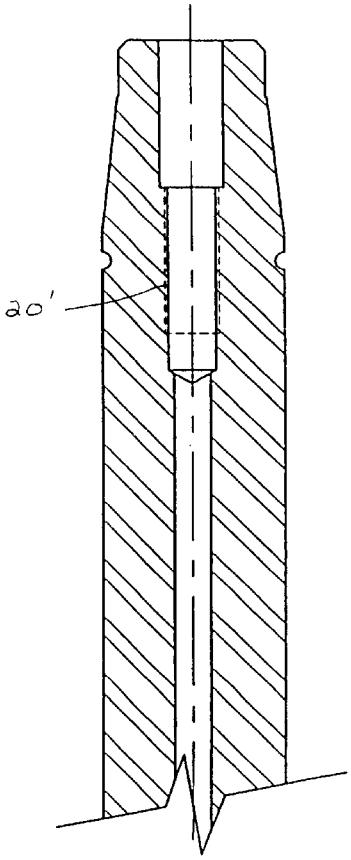
FIG 1C (Prior Art)
FIG. 1C is a cross-sectional view of an upper end of a shaft for a tapered coupling design in accordance with a known prior art design.
Figure 2:
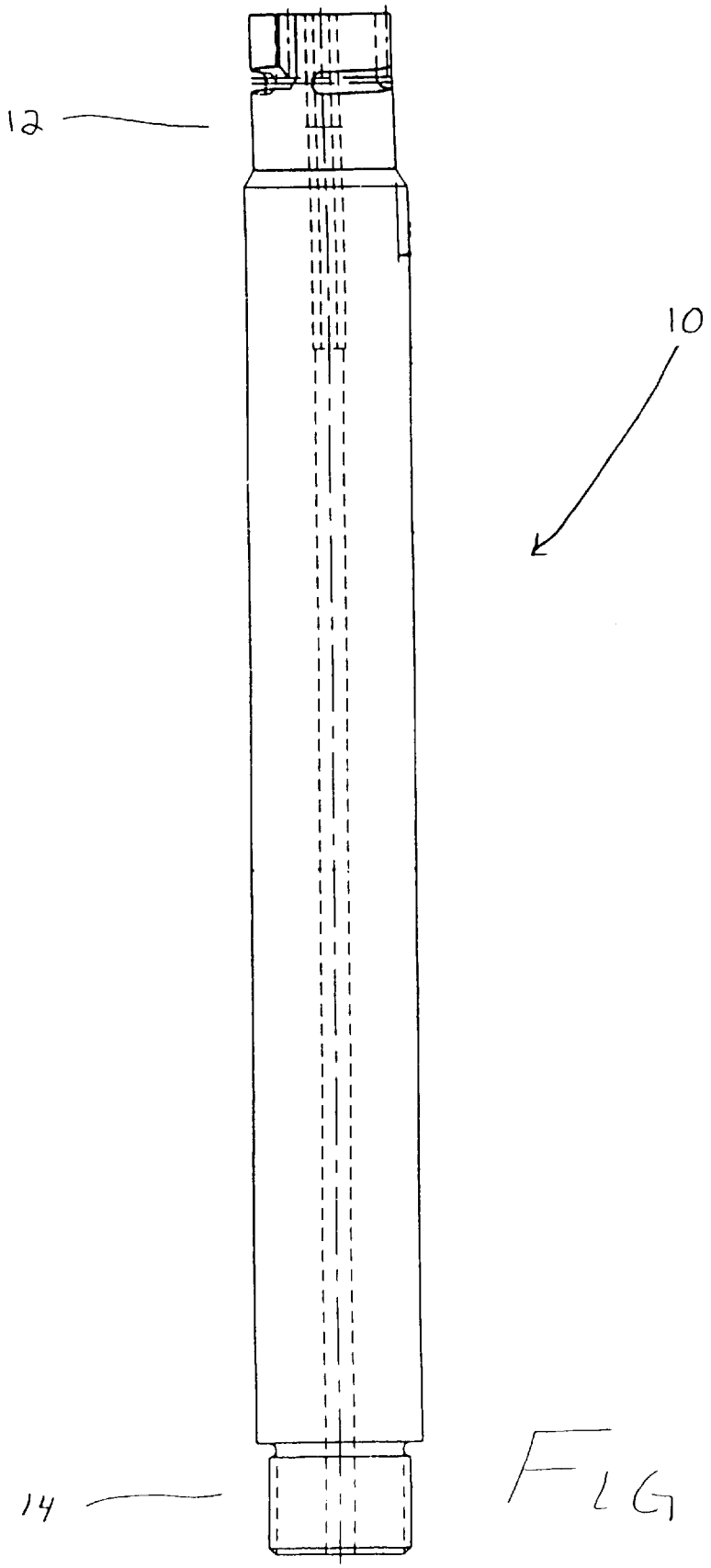
FIG. 2 is a side view of a shaft for a molten metal processing system in accordance with the present invention.

With reference to FIG. 2, a shaft 10 for a molten metal processing system, such as a degasser, is shown in accordance with the present invention. The shaft, which is an elongated member having a substantially cylindrical shape, includes a first upper end 12 and a second lower end 14. The upper end of the shaft is coupled to a drive system 16 (see FIG. 4A) while the lower end is adapted to connect to an impeller or rotor (not shown). The shaft is preferably constructed from graphite. However, constructing the shaft from other materials, such as ceramic, is within the scope and intent of the present invention.

Figure 3:
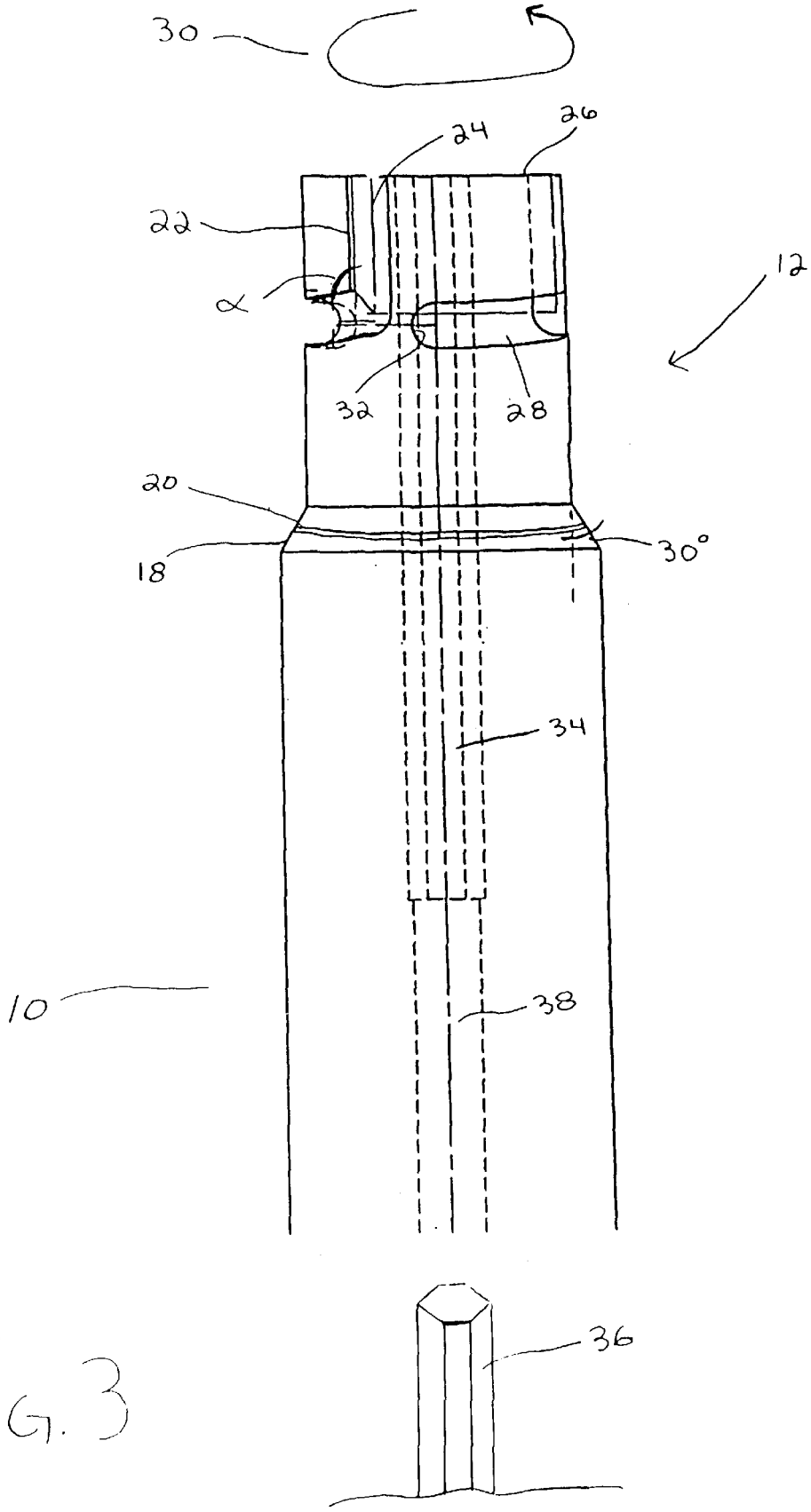
FIG. 3 is a side view of an upper axial end of a shaft and a wrenching tool for removing shaft stubs in accordance with the present invention.

Turning now to FIG. 3, a view of the upper end 12 of the shaft 10 is shown. Before terminating at the upper end, the shaft tapers so that its upper end has a smaller diameter than a diameter of an intermediate portion of the shaft. The decrease in diameter along the shaft forms a tapered seat 18, preferably angled at 30° relative to vertical. An annular ridge or protrusion 20 is arranged concentrically along a surface of the tapered seat. Of course, multiple protrusions or any location of the protrusion suitable for sealing can be used.

A plurality of channels 22 are machined into an outer concentric wall of the upper end of the shaft. Each channel includes a first portion 24 which extends vertically or longitudinally downward from a top surface 26 of the shaft. A second portion 28 extends from the first portion of each channel at an angle slightly greater than 90° (angle $\alpha$) relative to the channel's first portion. The second portion extends from the first portion in a direction opposite a direction of rotation 30 of the shaft. The second portion terminates into a rounded surface 32 at a predetermined location along the outer wall of the shaft's upper end. The length of the second portion is preferably less than one third the perimeter of the shaft's upper end. In a preferred embodiment, three channels 22 are machined into the upper end of the shaft with their first portions 24 being spaced approximately 120° from each other. However, greater or fewer channels having different spacings are contemplated by the present invention.

In a preferred design, a longitudinal passage 34 is provided along a central longitudinal axis of the shaft. The passage, which extends downward from the top surface of the shaft approximately six inches, is preferably a non-round or torque facilitating shape. In the illustrated embodiment, the passage is machined having a hexagonal shape. Thus, if the shaft breaks during operation, the hexagonal passage accommodates a wrenching tool 36, such as a hex wrench, which can engage the remaining portion of the shaft for removal. The passage need only be six inches in length because when a shaft breaks, it typically breaks within six inches of the shaft's upper end.

If the invention is to be used for degassing applications, a second passage 38 extends from passage 34 through the entire length of the shaft and into a rotor attached at the lower end 14 of the shaft. Passage 38 allows gas to travel through the shaft and into the molten metal bath via the attached rotor. The second passage preferably is constructed with a circular shape because it is easier and less expensive to machine than a hexagonal shape.

Figure 4A:
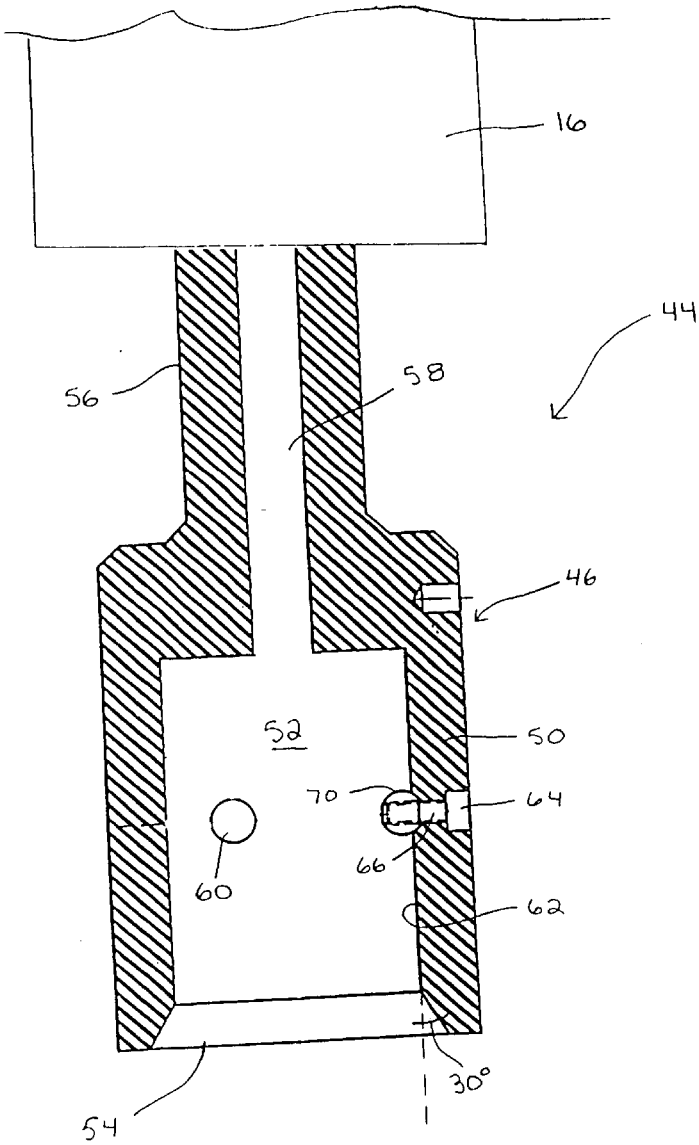
FIG. 4A is a cross-sectional view of a coupling member and an associated motor in accordance with the present invention.
Figure 4B:
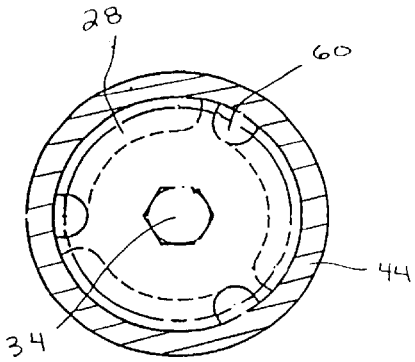
FIG. 4B is a top cross-sectional view of a coupling member engaging a shaft in accordance with the present invention.

With reference now to FIGS. 4A and 4B, the upper end 12 of the shaft 10 is adapted to be received by a coupling member 44 which functions to couple the shaft to the drive system 16. The coupling member 44 includes a main body 46 having an annular wall 50 which defines a substantially cylindrical cavity 52. The cylindrical cavity tapers outwardly forming a mouth 54 having a larger diameter than the cavity diameter. The mouth preferably tapers outwardly at 30° relative to vertical so that it can sealingly engage the inwardly tapered seat 18 of the shaft which is also angled at 30° relative to vertical. A neck 56, extending downwardly from the drive system 16, is attached to a top portion of the main body of the coupling member. In the degassing embodiment, a gas passage 58 extends longitudinally through a central axis of the neck and communicates with passage 34 of the shaft.

A series of locking members 60 are disposed concentrically around an inner surface 62 of annular wall 50. All of the locking members are preferably located in the same horizontal plane. In the illustrated embodiment, each locking member includes a base 64 having a stem 66 extending radially inward from the annular wall 50 of the coupling member 44. The stem extends through the annular wall and terminates shortly after penetrating through the inner surface of the annular wall. A rounded member 70 is attached to the free end of the stem and is the only visible portion of each locking member. Preferably, three locking members are disposed within the cavity of the locking member. Like the first portions 24 of channels 22, the locking members are spaced approximately 120° from each other. However, greater or fewer locking members having different spacings are contemplated by the present invention.

To effectively couple the drive system 16 to the shaft 10, the locking members 60 of the coupling member 44 are aligned with the first portions 24 of the channels 22. The width of the first portion of each channel is greater than the diameter of each locking member. The shaft is slid into the cavity 52 of the coupling member until each locking member reaches a bottom surface of the first portion of one of the channels. The shaft is then rotated causing the locking members to enter the second portions 28 of the channels. Since the second portion of each channel is angled downwardly at an angle less than 90°, the rotation of the shaft pulls the coupling member and the shaft together in a cam locking manner. Furthermore, because the second portion of each channel extends from the first portion in a direction opposite the direction of rotation of the shaft, the locking members are continually being urged into a tighter and more secure locking relationship with the second portions of the channels while the system is in operation.

When coupling the shaft to the drive system, the mouth 54 of the coupling member engages and seals against the tapered seat 18 of the shaft in a mating manner. The annular ridge 20 arranged around the tapered seat enhances the gas sealing properties when the device is used in connection with a degassing system. The shaft becomes securely coupled to the drive system when the locking members 60 have traveled approximately half way through the second portions 28 of the channels. Thus, less than a one third rotation of the shaft is required to achieve a secure connection. The untraveled half of each channel's second portion provides plenty of additional room in case the shaft needs to be rotated more than expected. Such a need may arise because of machining error, material deformations over time, etc.

The present coupling design provides a simple self-aligning method for coupling a shaft to a drive system. Less than one third of a rotation is required in order to accomplish a tight locking relation. This is a significant advantage over known coupling designs which require several rotations in order to couple the shaft to the drive system.

If the shaft fails, the remaining portion stuck within the coupling can be easily removed without damaging the system. The easy removal can be achieved because the remaining shaft portion need only be turned less than one third of a rotation to remove the shaft stub. The passage 34, which has a torque facilitating shape, and wrenching tool 36 make such a task rather easy when compared to the several disengaging shaft rotations required to remove a shaft stub in conventional systems. Removal of a broken shaft piece is also made easier because the shape of the mating surfaces in the present invention offers less resistance to disengaging rotation than engaging rotation. By providing for easy removal that does not damage the system, the potential for shaft run-out is also decreased.

When the present invention is used with a degassing system, its sealing properties are optimal. A tight seal is necessary in such applications in order to force an injected gas through passage 34 and passage 38. Optimal sealing characteristics are achieved by the present invention because the tapered seat 18 of the shaft 10 engages the mouth 54 of the coupling member and provides a gas tight seal. Additionally, the annular ridge 20 located on the surface of the shaft's tapered seat 18 provides enhanced sealing properties. By sealing the system in such a manner, the need for an O-ring, gasket, or other sealing agent is eliminated.

Another significant feature of the present invention is that it offers increased ultimate strength for a rotor/shaft system. The mechanical machining of the present coupling design creates less stress risers in the ceramic or graphite shaft when compared to the machining of conventional coupling designs. In addition the tapered mating surfaces of the coupling design supports much of the cantilevered bending loads. Both of these factors contribute to the increased ultimate strength achieved by the present invention.

Thus, it is apparent that there has been provided, in accordance with the present invention, a coupling design for a rotor/shaft system that fully satisfies the objects, aims and advantages set forth above. While the invention has been described in conjunction with specific embodiments thereof, it is evident that many alternatives, modifications, and variations will be apparent to those skilled in the art. In light of the foregoing description, accordingly, it is intended to embrace all such alternatives modifications, and variations as fall within the spirit and broad scope of the appended claims.

I claim:

1. A coupling mechanism for a molten metal processing system comprising:

an elongated shaft having a first axial end and a second axial end, at least one channel disposed on an outer surface of the first axial end; and a coupling member for connecting the first axial end to a drive system, the coupling member having a cavity for receiving the first axial end of the shaft and at least one locking member disposed on a wall of the cavity adapted to cooperate with the at least one channel in a locking relationship restricting further rotational movement in at least one direction after the elongated shaft is in a locked relationship with the coupling member.

2. The coupling mechanism according to claim 1, wherein the channel includes a first portion extending longitudinally downward from a top surface of the shaft and a second portion extending at an angle from the first portion.

3. The coupling mechanism according to claim 2, wherein the second portion of the channel extends from the first portion of the channel at an included angle greater than 90°.

4. The coupling mechanism according to claim 2, wherein the second portion of the channel extends from the first portion a distance less than one third of a perimeter of the first axial end of the shaft, the locking member adapted to slide down the first portion of the channel and at least partially across the second portion of the channel.

5. The coupling mechanism according to claim 2, wherein the second portion of the channel extends from the first portion of the channel in a direction opposite a direction of rotation of the shaft.

6. The coupling mechanism according to claim 1, wherein the first axial end of the shaft has first, second and third spaced channels each having a first portion extending vertically downward from a top surface of the elongated shaft and a second portion extending from the first portion at an included angle greater than 90°, the coupling member having first, second, and third spaced locking members which are adapted to align with and slide down the first portion of the first, second, and third channels respectively and slide at least partially across the second portion of the first, second, and third channels respectively so that the shaft is secured to the coupling member in a cam locking manner.

7. The coupling mechanism according to claim 1, wherein the elongated shaft tapers inwardly as the top axial end is approached forming a tapered seat at a predetermined position along the elongated shaft.

8. The coupling mechanism according to claim 7, wherein at least one annular ridge is disposed on a surface of the tapered seat.

9. The coupling mechanism according to claim 7, wherein an inner surface of the cavity of the coupling member tapers outwardly thereby forming a mouth, the mouth engaging the tapered seat of the shaft effectively sealing the coupling mechanism.

10. The coupling mechanism according to claim 9, wherein the tapered seat is angled inwardly at approximately 30° relative to an outer vertical surface of the first end of the shaft and the mouth is tapered outward at approximately 30° relative the wall of the cavity.

11. The coupling mechanism according to claim 1, further comprising a first passage having a torque facilitating shape extending longitudinally through at least a portion of the elongated shaft adapted to receive a wrenching tool.

12. The coupling mechanism according to claim 11, wherein the first passage is hexagonal in shape and extends downward from a top surface of the shaft, the first passage terminating before reaching the second end of the shaft.

13. The coupling mechanism according to claim 11, further comprising a second passage extending longitudinally from the first passage through the entire elongated shaft.

14. A coupling device for a molten metal processing system comprising:

at least one channel machined into a first surface of a shaft; and at least one locking member mounted to a second surface, the at least one locking member adapted to cooperate with at least one channel in a locking relationship, the locking member restricting further rotational movement of the shaft in at least one direction.

15. The coupling device according to claim 14, wherein the first surface is an outer surface of an upper end of the shaft and the second surface is an inner surface of an annular wall of a coupling member.

16. The coupling device according to claim 14, wherein the channel includes a first vertical portion extending longitudinally downward from a top portion of the first surface and a second portion extending at an angle from the first portion.

17. The coupling device according to claim 16, wherein the second portion of the channel extends from the first portion of the channel at an angle greater than 90° relative to the first portion.

18. The coupling device according to claim 14, wherein the first surface has a tapered portion which forms a tapered seat at a predetermined position along the first surface.

19. The coupling device according to claim 18, wherein the second surface tapers outwardly forming a mouth for engaging the tapered seat of the first surface thereby effectively sealing the coupling device.

20. A molten metal processing system comprising:

a drive system;

a coupling member extending downward from the drive system;

an elongated shaft having a first end and a second end, the coupling member coupling the first end of the shaft to the drive system; and a first passage having a torque facilitating shape extending longitudinally through at least a portion of the elongated shaft adapted to receive a wrenching tool.

21. The molten metal processing system according to claim 20, wherein the first passage is hexagonal in shape and terminates before reaching the second end of the shaft.

22. The molten metal processing system according to claim 20, wherein the processing system is a degassing device having a second passage extending longitudinally from the first passage.

23. The molten metal processing system according to claim 22, wherein the elongated shaft tapers inwardly forming a tapered seat at a predetermined position along the elongated shaft.

24. A method for coupling a shaft of a molten metal processing system to a drive system of the molten metal processing system comprising the steps of:

machining at least one channel into an upper end of the shaft, the channel having a first portion extending vertically downward from a top surface of the shaft and a second portion extending from the first portion at an angle greater than 90° relative to the first portion, the channel adapted to restrict further rotational movement of the shaft in at least one direction;

providing at least one locking member on an inner surface of an annular wall of a coupling member which is adapted to cooperate with the at least one channel;

aligning the locking member with the first portion of the channel;

sliding the shaft into the coupling member until the locking member has reached a bottom surface of the first portion of the channel; and turning the shaft so that the locking member travels partially through the second portion of the channel until the coupling member and the shaft are securely connected.

25. The method of coupling a shaft to a motor according to claim 24, wherein the turning step includes turning the shaft less than one third of a rotation.

26. A shaft for a molten metal processing system comprising:

an elongated body having a first axial end dimensioned to be coupled to a drive system and a second axial end adapted for connection to an associated rotor or impeller; and at least one channel adapted to restrict further rotational movement in at least one direction and to restrict longitudinal movement after the elongated body is coupled to the drive system disposed on an outer surface of the first axial end, the channel having a first portion extending longitudinally downward from a top surface of the shaft and a second portion extending at an angle from the first portion.

27. The shaft according to claim 26, wherein the second portion of the channel extends from the first portion of the channel at an included angle greater than 90°.

28. The shaft according to claim 26, wherein the shaft is fabricated from a graphite or a ceramic material.

29. The shaft according to claim 26 including an impeller or rotor connected to said second axial end.

30. The shaft of claim 26 including an elongated passage extending from said first axial end at least a portion of the length of said shaft.

31. The shaft of claim 30 wherein said passage extends from said first axial end to said second axial end.

32. The shaft of claim 31 wherein said elongated passage has a cross-section shape which accommodates a torque wrenching tool.

33. A coupling mechanism for a molten metal processing system comprising:

an elongated shaft having a first axial end and a second axial end, at least one channel disposed on an outer surface of the first axial end; and a coupling member for connecting the first axial end to a drive system, the coupling member having a cavity for receiving the first axial end of the shaft and at least one locking member disposed on a wall of the cavity adapted to cooperate with the at least one channel in a locking relationship, wherein the channel includes a first portion extending longitudinally downward from a top surface of the shaft and a second portion extending at an angle from the first portion.

* * * * *